United States Patent [19]

Gentile, Jr.

[11] Patent Number: 4,528,889

[45] Date of Patent: Jul. 16, 1985

[54] ELECTRONIC INSTRUMENT STRING CLEANER

[76] Inventor: Joseph P. Gentile, Jr., 248 W. Acacia St., Stockton, Calif. 95203

[21] Appl. No.: 611,137

[22] Filed: May 17, 1984

[51] Int. Cl.[3] ..... G10G 7/00

[52] U.S. Cl. ..... 84/453; 15/104.52; 15/104.93; 15/210 R

[58] Field of Search ..... 84/453; 15/104.5–104.54, 104.93, 210 R

[56] References Cited

U.S. PATENT DOCUMENTS 4,112,808 9/1978 Ketterer ..... 84/453

FOREIGN PATENT DOCUMENTS 3003402 8/1981 Fed. Rep. of Germany ..... 84/453

*Primary Examiner*—Lawrence R. Franklin

*Attorney, Agent, or Firm*—Mark C. Jacobs

[57] ABSTRACT

A hand held device for cleaning the strings of an electrical and acoustical guitars is disclosed which cleans in between the windings and all around the surface of strings simultaneously and easily while on the instrument.

7 Claims, 10 Drawing Figures

ELECTRONIC INSTRUMENT STRING CLEANER

BACKGROUND OF THE INVENTION

Since the advent of rock and roll, electrical stringed instruments have come into their own. Playing a stringed instument involves touching of the strings, consequently a residue build up arises. This build up deadens the tone of the strings thus necessitating replacement of the strings. There is no satisfactory method of cleaning the strings.

The need, therefore, exists for a device to clean the strings of these instruments, while maintaining the strings in place on the instrument.

It is another object to provide a device that brushes out residue in winding of strings that are wound.

It is another object to provide a device that brushes off residue build up on solid strings.

It is another object to provide a device that brushes out residue in winding of strings and residue on solid strings when both wound and solid strings are used in one instrument.

It is another object to provide a device that cleans the strings of instruments that are on the same plane simultaneously.

It is another object to provide a device that cleans the strings of instruments that are on a radius by cleaning one, two or three at one time.

Other objects of the invention will in part be obvious and will in part appear hereinafter.

The invention accordingly comprises the several steps and the relation and order of one or more of such steps with respect to each of the others, and the product possessing the features, properties and the relation of elements which are exemplified in the following detailed disclosure, and the scope of the application of which will be indicated in the claims.

For a fuller understanding of the nature and objects of the invention, references should be had to the following detailed description taken in connection with the accompanying drawings.

SUMMARY OF THE INVENTION

A cleaning device having a cleaning cloth with three sectors, which cloth nestles around the strings af a string instrument, and which when used in a zig-zag motion, cleans the strings of a stringed musical instrument.

DESCRIPTION OF THE PREFERRED EMBODIMENT

Figure 1:
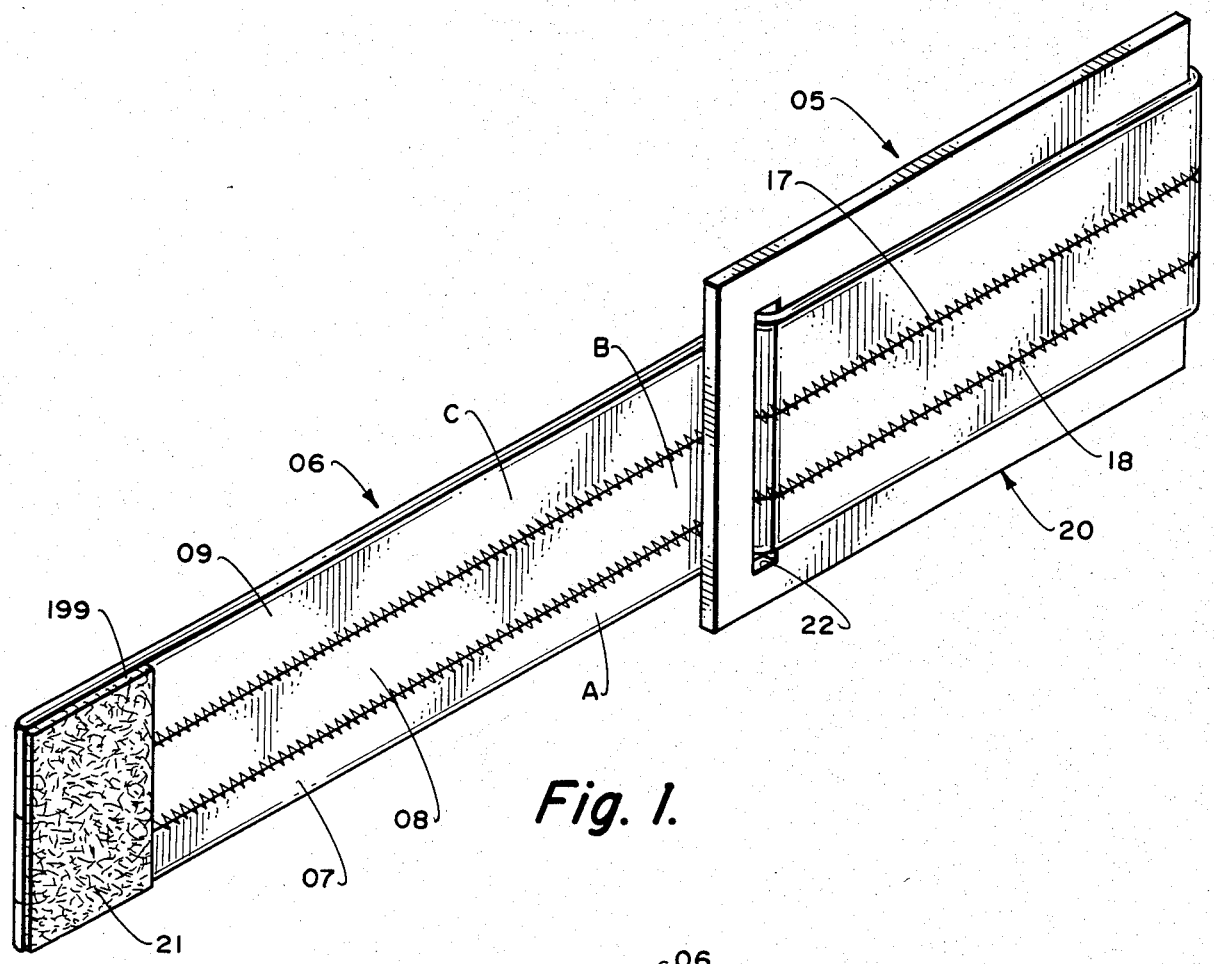
FIG. 1 is a top perspective view of the device of this invention.

The instant device is shown in FIG. 1. It is a cleaning instrument for cleansing the strings of electric stringed instruments; such as an electric guitar. The components of device 05 are best seen separately in FIGS. 2,3,and 4. Thus it is seen that device 05 consists of cloth portion 06 and a support 20.

Cloth porton 06 is seen to comprise three (3) sections of cloth overlain on their edges and sewn together. Thus the layers are designated 07,08,09 each of which is functionally different and constituently different as will pointed out in detail below. The three pieces of fabric are edged to edge and sewn to each other A to B to C style, along seams of stitches 17 and 18, which connect section 07 to 08 and 08 to 09 respectively.

The second element of the instant invention is support 20. It is seen that this support is a rectangular planar member, having a thickness of about $\frac{5}{8}$ inch in order to have a non-flexible member. Such a support 20 may be made of plastic; for example styrene or ABS; metal such as aluminum or painted steel; or wood as may be desired.

Support 20 includes a vertically elongated slot 22 through which cloth 06 is threaded during times of use as will be explained below. Support 20 also includes a section of Velcro ® closure 24, preferably a male portion, which closure material is adhesed by adhesive layer 25 to a location spaced distant from the elongated slot aforesaid. See FIGS. 3 and 4.

Figure 4:
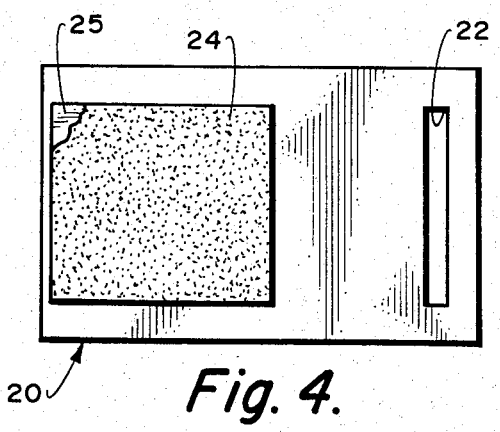
FIG. 4 is a back view thereof.
Figure 5:
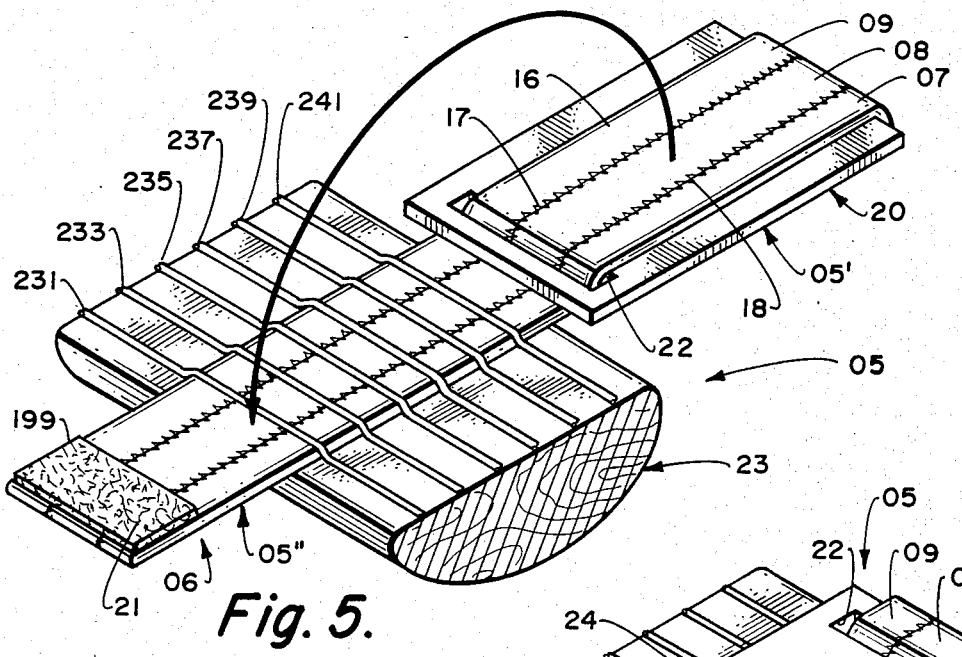
FIG. 5 is a diagrammatic view showing commencement of use of the instant device.
Figure 6:
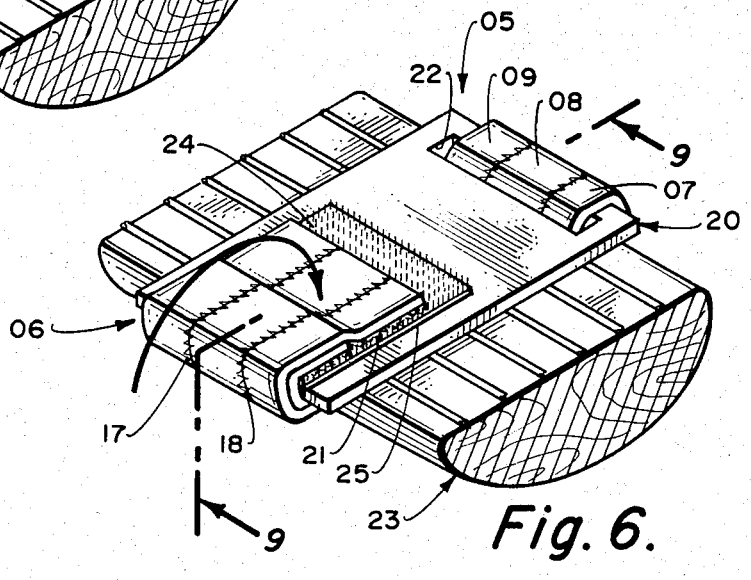
FIG. 6 is a top plan view of the instant device.

In FIG. 5, we see the electrical or acoustical guitar shown in fragment and designated 23. The strings 231, 233, 235, 237, 239 and 241 are seen to be on top of one portion of device namely 05″ the second portion 05′ is about to be closed over said strings for the cleaning process as will be described below with respect to FIGS. 7,8, and 9. The Velcro ® surface 21 of tab 199 is to be folded over as illustrated in FIG. 6 to matingly engage Velcro surface 24 as seen in FIG. 4, the movement of which is best understood by reference to FIG. 6. See also FIG. 9, and the discussion of said figure infra.

Figure 7:
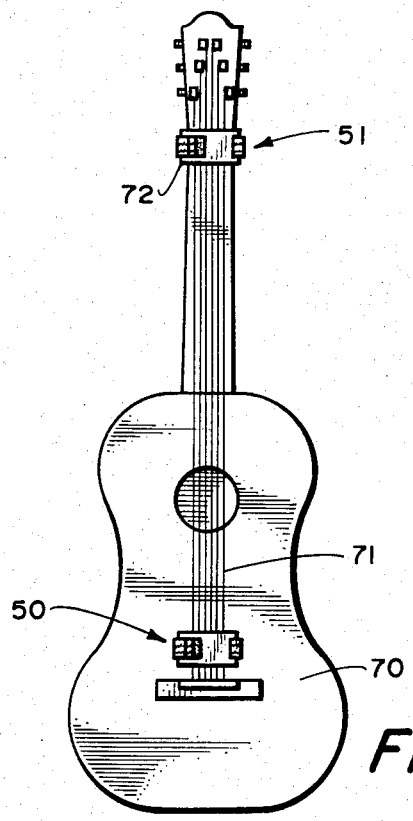
FIG. 7 is a diagram illustrating the movement of the device during its useage.

FIG. 7 illustrates the placement of the device of this invention on the neck 71 of an electric or acoustical guitar 70. This location is location A and is designated 50. This same drawing also illustrates the proper positioning of the instant device on the frets 72 of said guitar 70. This location B is designated 51.

Figure 8:
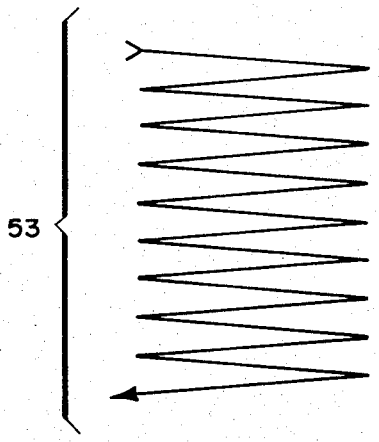
FIG. 8 is a diagrammatic view of the mode of use hereof.

The instant device when wrapped around the electrical or acoustical instrument's strings is moved up and down in a reciprocating motion, designated 53, which motion is illustrated in Figure 8. That is, the reciprocation is coupled with vertical movement down the strings or up the strings depending on the location which cleaning was commenced. A closer view of the cleaning position can be understood by reference to FIG. 5 as well as to FIG. 7.

Figure 9:
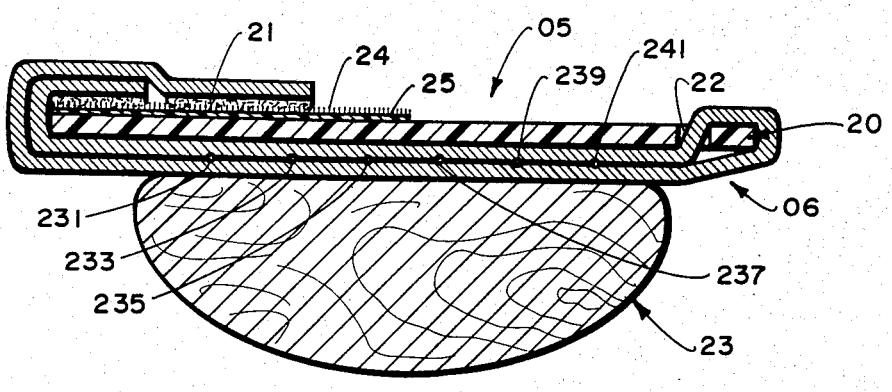
FIG. 9 is a side elevational view taken along line 9—9 of FIG. 6.
Figure 10:
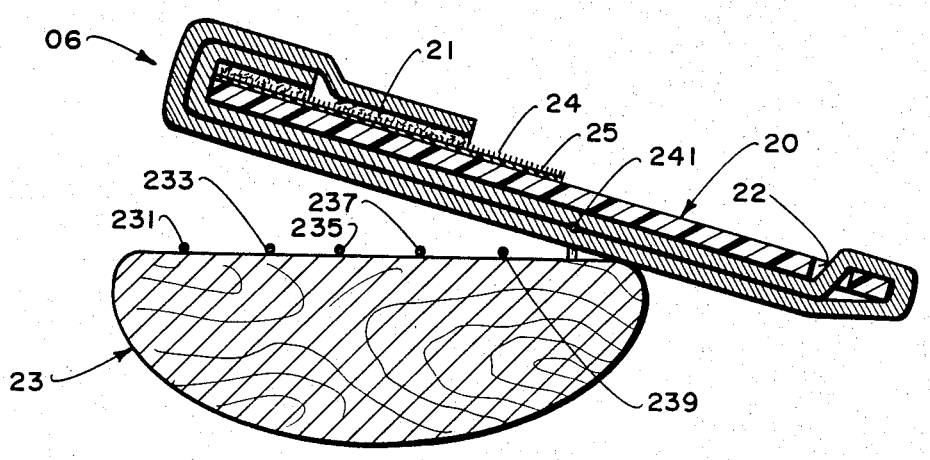
FIG. 10 is a cross section view showing further utility of the instant device.

In FIG. 9, a view from the top, it is clearly seen how strings 231, 233, 235, 237,239 and 241 have both sides of the string come into simultaneous contact with the cleaning surfaces of this invention. Reference is made to FIG. 10, wherein an alternate use of device 05 is illustrated. Here, only a single string 241 of acoustical guitar 23 is being cleaned. Here too the motion shown in FIG.

8, namely a zig-zag pattern should be employed during downward travel of the device 05.

It is seen that I have provided a unique device for musicians that permits them to clean all around the strings of electronic and acoustical music instruments quickly and easily. The cleaning procedure involved is not detrimental to the finish of the wood casing of the instrument. Furthermore, the cleaning procedure and the tool of this invention can be manufactured easily and cheaply thereby permitting even the youngest, amateur musician to cleanse the strings of his electronic instrument as often as may be necessary.

In addition, the ease of replacement of the three-part cloth due to excess soiling or wearing out is indeed a further benefit. One need merely undo the Velcro® fasteners and replace the threepart cloth.

A preferred size for the cleaning aid polishing cloth is about twelve and a half ($12\frac{1}{2}$) inches long by about two (2) inches high or wide, the brushing middle layer about three-fourths ($\frac{3}{4}$) inch high and the drying layer or band should be about seven-eights ($\frac{7}{8}$) inch high. Typically a support or such a cloth would be about four and three-fourths ($4\frac{3}{4}$) inches wide by two and three-fourths ($2\frac{3}{4}$) inches high.

Figure 2:
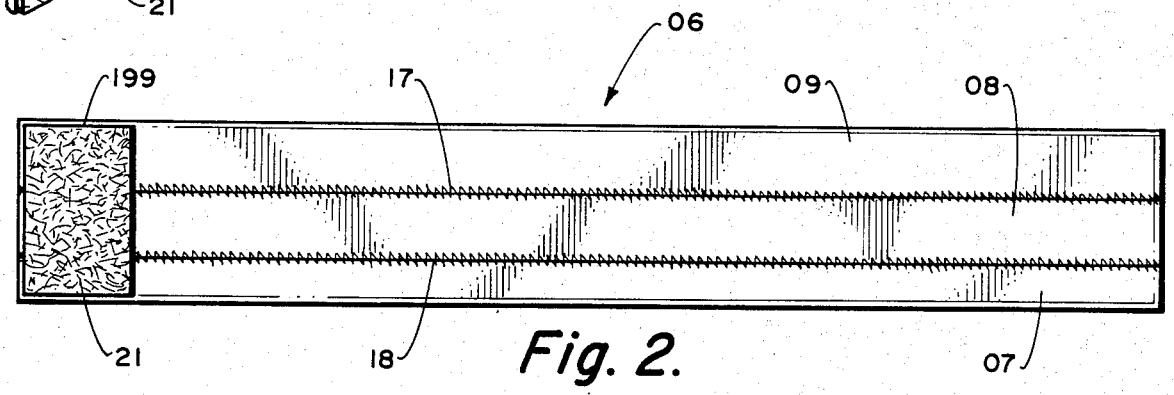
FIG. 2 is a front plan view of one element of this invention.
Figure 3:
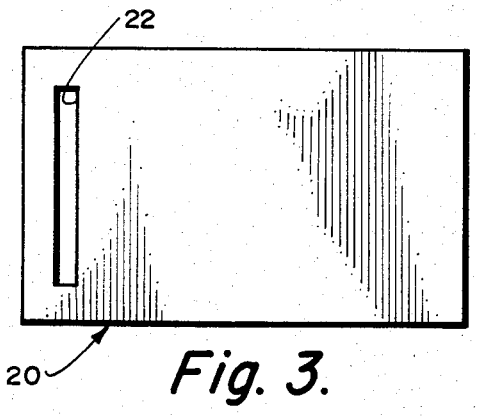
FIG. 3 is a front plan view of a second component of this invention.

Turing back to FIG. 2, which illustrates the novel cloth structure of the instant device. It is seen that structure 06 is comprised of three (3) separate sections of different cloth in butt edge relationship. The relationship is achieved by abutting a portion of the lower most layer and the top most layer each with the middle layer, and then sewing each pair together. The stitches that butt join the two top and the two bottom layers are designated 17 and 18 respectively. Obviously a glueing method can be used with equal facility.

The blue or lower most material is adapted to receive an alcholic base or other string cleaning compositon offered in the marketplace. Typically a cotton velour or cotton flannel is useable for this purpose.

The middle or white layer is a high nap cloth and is used for scrubbing the strings with the fluid just applied upon the blue layer. Typically a nylon pile is employed as this section.

The uppermost or brown layer is used to clean and dry the strings after they have been soaked and cleaned by the top two layers.

Typically a cotton fabric such as a low nap velour is suggested. The layer must be capable of absorbing the residue liquid from the strings and holding onto it.

While FIG. 2 has been lined for color, this has been done merely for clarity. There is no criticality for any special color for the bands. To the contrary the only important feature is the careful selection of the several bands to perform their functions in the order recited.

Any suitable cleaning agent, such as alcohol or other string cleaner solutions may be employed herein.

While the support or base is shown to be rectangular, a triangular, square or other shaped one can be similarly employed. Care should be taken that the support is generally sized to the multi-band cloth in order to minimize risk of contact of the support with the strings.

While Velcro® has been described as the preferred closure or securing system, any two part releasable closure such as snaps can be similarly employed. It is also within the scope of the invention to have one end of the cleaning cloth secured to the support thus negating removability.

It is seen that the multi-band cloth should be at least twice the length of the support in order to fold over and engage the securing means thereupon.

On all electrical and acoustical stringed musical instruments the strings are parallel to each other. On all electrical instruments the strings are parallel to each other and are on the same plane. On some acoustical instruments the strings are on the same plane. On other acoustical insstruments the strings are on a radius.

The device of this invention works with equal facility on all types of electrical and acoustical instruments regardless of string to string planar relationship.

The cleaning device of this invention renews the tone of the instrument, permits string longevity and negates the necessity of removing the strings from the instrument.

While the preferred ebodiment employs the three discrete layers of cloth as discussed above, it is also to be seen that most, if not all, of the aspects of the process and the benefits to be derived from utilizing separate and distinct layers can be accomplished by utilizing a single layer of cloth.

If fact, it is within the scope of this invention to employ a material that has the clinging characteristics of Velcro®. That is, the material used in a single layer would cling to the male or hook containing portion of the Velcro to enable the single layer cloth to be secured releasably as is called out in detail above.

Such a single layer cloth, while being able to moisten and "brush" the strings in accordance with the procedure of FIG. 8, may if fully saturated with fluid not be able to dry the strings. Such a unitary layer cloth is manufactured and sold by Morgan Fabrics under the trademark Tempo TM.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A device for cleaning the strings of electric and acoustic stringed instruments comprising:

a. an elongated planar support member having a first and a second surface and having a slot normal to the length thereof spaced inwardly from one edge thereof, said planar member including first releasable securing means mounted on the first surface thereof, b. an elongated cleaning and polishing cloth, longer than twice the length of the support and having a front and back side and sized in elevation to fit through said slot, said cloth having a pair of second releasable securing means engagable with the first securing means of said support, one of said second securing means being attached to the front side of said cloth, and the second of said second securing means being mounted on the back side of said cloth each at opposite ends of said cloth, c. said cloth being releasably secured to said support on one end, the other end of which is inserted through said slot.

2. The device of claim 1 wherein said first and second securing means are Velcro® fasteners.

3. The device of claim 2 wherein the Velcro® fastener is adhesed to the support and sewn onto the cloth.

4. The device of claim 1 wherein the cleaning and polishing cloth comprises three vertically connected bands of cloth of differing properties.

5. The device of claim 4 wherein the first band is adapted to receive and apply the cleaning solution, the second band is adapted to brush the strings, and the third band is adapted to dry the strings.

6. The device of claim 4 wherein the lowermost band of cotton fabric, the middlemost is a pile fabric, and the uppermost is a cotton fabric.

7. In the device of claim 1 wherein the cloth is secured on one side to said support.

* * * * *

UNITED STATES PATENT AND TRADEMARK OFFICE

CERTIFICATE OF CORRECTION

PATENT NO. : 4,528,889

DATED : July 16, 1985

INVENTOR(S) : JOSEPH P. GENTILE, JR.

It is certified that error appears in the above-identified patent and that said Letters Patent are hereby corrected as shown below:

In Col. 2, line 17, change "edged" to --edge--.

In Col. 2, line 22, change "5/8" to --1/8--.

In Col. 3, line 16, change "threepart" to --three-part--.

In Col. 4, line 9, correct the spelling of "insstruments" to --instruments--.

In Col. 4, line 24, change "If" to --In--.

Signed and Sealed this

*Twenty-ninth* Day of *October 1985*

[SEAL]

*Attest:*

DONALD J. QUIGG

*Attesting Officer*

*Commissioner of Patents and Trademarks—Designate*